US012529373B1

(12) United States Patent
Krug

(10) Patent No.: US 12,529,373 B1
(45) Date of Patent: Jan. 20, 2026

(54) METHOD FOR AUTONOMOUS CONTROL OF OIL AND GAS WELL DOWN-HOLE PUMP SURFACE UNIT AND REDUCTION OF GAS INTERFERENCE

(71) Applicant: David A Krug, Cedar Hills, UT (US)

(72) Inventor: David A Krug, Cedar Hills, UT (US)

( * ) Notice: Subject to any disclaimer, the term of this patent is extended or adjusted under 35 U.S.C. 154(b) by 87 days.

(21) Appl. No.: 17/468,342

(22) Filed: Sep. 7, 2021

Related U.S. Application Data

(60) Provisional application No. 63/076,311, filed on Sep. 9, 2020.

(51) Int. Cl.

| | |
|---|---|
| ***F04B 47/02*** | (2006.01) |
| ***E21B 43/12*** | (2006.01) |
| ***E21B 47/008*** | (2012.01) |
| ***F04B 49/02*** | (2006.01) |
| ***F04B 49/12*** | (2006.01) |
| ***F04B 49/20*** | (2006.01) |
| ***F04B 51/00*** | (2006.01) |
| *F04B 47/06* | (2006.01) |
| *F04B 49/00* | (2006.01) |

(52) U.S. Cl.
CPC ..... *F04B 49/20* (2013.01); *E21B 43/126* (2013.01); *E21B 47/008* (2020.05); *F04B 47/02* (2013.01); *F04B 49/02* (2013.01); *F04B 49/12* (2013.01); *F04B 51/00* (2013.01); *F04B 47/06* (2013.01); *F04B 49/00* (2013.01); *F04B 2201/06011* (2013.01); *F04B 2201/121* (2013.01)

(58) Field of Classification Search
CPC ..... E21B 43/126; E21B 43/008; F04B 49/02; F04B 49/12; F04B 49/20; F04B 47/02; F04B 51/00; F04B 2201/06011; F04B 2201/121
See application file for complete search history.

(56) References Cited

U.S. PATENT DOCUMENTS

| | | | |
|---|---|---|---|
| 1,877,467 | A | 9/1932 | Lake |
| 1,889,730 | A | 11/1932 | Lake |
| 2,673,613 | A | 3/1954 | Irwin |
| 2,741,915 | A | 4/1956 | Renken et al. |
| 3,152,474 | A | 10/1964 | Jay |
| 3,527,094 | A | 9/1970 | Yew et al. |
| 3,838,597 | A | 10/1974 | Montgomery et al. |
| 3,851,995 | A | 12/1974 | Mills |
| 3,951,209 | A | 4/1976 | Gibbs |
| 3,972,648 | A | 8/1976 | Sangster |

(Continued)

*Primary Examiner* — Charles G Freay
(74) *Attorney, Agent, or Firm* — Peter L. Brewer; Thrive IP

(57) ABSTRACT

A method for the autonomous control of a surface unit of an oil well or gas well down-hole rod pump to provide for a reduction of gas interference and an increase in production, the method providing for autonomous adjustment of one or more pump operation characteristics, including one or more of dwell time, polished rod travel, compression ratio, and pump cycle rate, and the method including autonomous determination of a weight transfer position, autonomous determination of a rate of weight transfer, determination of a stretch factor of the polished rod, and autonomous adjustment of one or more of the pump operation characteristics for successive pump cycles of the down-hole pump installation based upon the weight transfer position, the rate of weight transfer, and the stretch factor.

17 Claims, 10 Drawing Sheets

(56) References Cited

U.S. PATENT DOCUMENTS 3,998,568 A * 12/1976 Hynd ..... F04B 49/06 417/12
4,015,469 A 4/1977 Womack et al.
4,043,191 A 8/1977 Mills
4,064,763 A 12/1977 Srinivasan
4,125,163 A 11/1978 Fitzpatrick
4,509,365 A * 4/1985 Eineichner ..... F04B 49/065 73/152.61
4,512,149 A 4/1985 Weaver
4,873,635 A 10/1989 Mills
4,947,936 A 8/1990 Ellwood
5,044,888 A 9/1991 Hester, III
5,123,330 A 6/1992 Roether et al.
5,182,946 A 2/1993 Boughner et al.
5,252,031 A 10/1993 Gibbs
5,458,466 A 10/1995 Mills
5,464,058 A 11/1995 McCoy et al.
5,481,873 A 1/1996 Saruwatari et al.
5,823,262 A 10/1998 Dutton
5,829,530 A 11/1998 Nolen
7,168,924 B2 1/2007 Beck et al.
7,212,923 B2 5/2007 Gibbs et al.
7,373,971 B2 5/2008 Montgomery
7,437,215 B2 10/2008 Anderson et al.
7,878,250 B2 2/2011 Sheldon
8,083,499 B1 12/2011 Krug et al.
8,562,308 B1 10/2013 Krug et al.
8,844,626 B1 9/2014 Krug
2004/0139149 A1 7/2004 De Sousa et al.
2005/0283277 A1 12/2005 Schulz
2006/0149476 A1 7/2006 Gibbs et al.
2007/0020110 A1 1/2007 Mills
2007/0286750 A1 12/2007 Beck et al.
2008/0010020 A1 1/2008 Ellender et al.
2008/0314581 A1 12/2008 Brown
2009/0024442 A1 1/2009 Brink et al.
2009/0024443 A1 1/2009 Graham et al.
2009/0055029 A1 2/2009 Roberson et al.
2009/0125367 A1 5/2009 Brink et al.
2009/0276100 A1 11/2009 Malki et al.
2011/0240937 A1 10/2011 McEwan et al.
2020/0182028 A1 * 6/2020 Ewing ..... E21B 43/127

* cited by examiner

METHOD FOR AUTONOMOUS CONTROL OF OIL AND GAS WELL DOWN-HOLE PUMP SURFACE UNIT AND REDUCTION OF GAS INTERFERENCE

RELATED APPLICATION

This application claims priority to and is a continuation of a prior filed U.S. provisional application, Application No. 63/076,311, filed on Sep. 9, 2020.

BACKGROUND OF THE INVENTION

Downhole Pump Operations

Regardless of the rod pumping surface unit installed on a well, it has but one purpose: to lift fluid from the bottom of the wellbore to the surface where the fluid is extracted at the wellhead. This process is accomplished through reciprocating a downhole pump.

When the downhole pump is operated with incomplete liquid fluid fillage percentages ranging from 0-100% of actual displaced pump volume, meaning the working barrel did not fill with liquid fluid 100% during the pump intake stroke. Or when gaseous fluid media fills this same working barrel volume during the same pump intake stroke, plus combinations and percentages of both routinely degrading the entire well location efficiencies.

These inefficiencies are leading causes of downhole component failures by inflicting excessive stress and strain on all pumping components. Creating lost revenue and production plus total operating cost increases including primary input energy required in addition to all costs associated with repairs and lost revenues.

The term fluid pound is known within the upstream energy sector. Fluid pound occurs when the traveling valve must travel an excess distance downward before contacting a resistive fluid level or resistance due to gas compression, or a combination of both within the working barrel trapped volume created during the previous pump intake stroke.

The energy creating the "pound" is generated from the falling kinetic energy made up of the polished rod string plus fluid column load multiplied by its velocity multiplied by its distance traveled in a given time frame, all of which is suddenly forced to stop and release or transfer some of this falling energy. The energy transfer described takes place every pump cycle. Sometimes this energy transfer is relatively smooth with minimal shock and other times it is extremely violent with excessive shock loading. The end result is the "pound".

The downhole pump has two purposes included in each lift and lower portion of the complete pump cycle. Lifting creates new pump intake volume within the pump working barrel while simultaneously transferring fluid out of the production tubing string at the wellhead.

Lowering pressurizes the previous volume intake which provides a means to open the traveling valve within the downhole pump assembly. Once the traveling valve opens, newly acquired liquid fluid intake volume is transferred past the traveling valve and starts the process of this liquid fluid volume being lifted to the surface.

As the polished rod string is lowered it must compress and pressurize the pump intake fillage volume from previous intake stroke now trapped within the working barrel and above the standing valve. This pressurization begins when the traveling valve contacts the fillage media that is able to resist the downward movement of the traveling valve.

As this pressurization process begins the working barrel media must first force the standing valve closed. It does so by opposing the fluid column head pressure of the annulus or any fluid level above the pump intake valve called the standing valve. This head pressure is commonly called pump intake pressure.

Upon closing the standing valve the working barrel is now blocked at its bottom end. The compression resistance force contained within the working barrel now opposes the downward traveling force of the combined polished rod string weight plus fluid column load supported by the closed and connected traveling valve. This lowering force is the energy to increase the trapped media volume pressure within the downhole pump.

The traveling valve is forced open when the pressure differential is greater on the working barrel plus standing valve side versus the suspended fluid column load side above the traveling valve. The pressure differential is caused by fluid resistance or gas compression resistance or combination of both resistances. As a general rule gas is compressible and liquid fluid is tremendously less compressible. It is entirely possible when this pressure differential is not high enough the traveling valve simply does not open.

When the traveling valve is finally forced open, the suspended fluid column above the traveling valve transfers to the tubing string and the closed standing valve. This process is called "weight transfer". A point or position of weight transfer may be measured on the polished rod. The rate at which this pressure release and weight transfer occurs contributes to the "fluid pound" effect. If weight transfer occurs at or near the top of the working barrel stroke, there is less pressure shock which occurs within the downhole pump and along the tubing string.

After the traveling valve is forced open, the polished rod and connected rod string continue lowering and displace the newly trapped media within the working barrel transitioning this new media above the traveling valve into the production tubing string.

The fluid media is eventually lifted from the bottom of the production tubing string up to the surface upon subsequent lifting portions pump stroke process, eventually expelling it out of the wellhead.

Weight Transfer Position and Rate of Change

The position of which this weight transfer occurs within the working barrel of the downhole pump is an indicator of downhole pump fillage media percentage and is called weight transfer position WTP.

The rate of change which the weight transfer occurs is an indicator of the fluid compressibility or density of the media volume trapped within the working barrel and between the closed standing valve and closed lowering traveling valve.

If weight transfer occurs quickly and at or near the top of total travel of the lowering polished rod string then the media fillage of the downhole pump percentage is high with minimal gas interference since fluid is less compressible than gaseous media.

If rate of change for weight transfer occurs slowly and begins at or near the top of total travel and continues to change as the polished rod string is lowered, it is an indicator of low density pump fillage volume. This is commonly called gas interference.

This trapped media or gas volume must first compress to create a pressure rise within the working barrel. This pressure rise acts on the traveling valve ball trying to force it off its traveling valve seat. The force keeping the ball on its seat is the hydrostatic head pressure of the fluid column above it.

When the pressure rise is not high enough the traveling valve does not open and no new reservoir fluid media enters the downhole pump.

The above two distinct scenarios are examples of what occurs downhole. It is very likely that variations of and combinations of these examples routinely take place depending upon actual downhole conditions.

Along with various pump fillage media compositions and density the actual downhole pump and its volumetric operating levels or leakage factors of performance also affect the ability to generate the internal pressure required to open the traveling valve.

These leakage factors vary between manufacturers. The original pump was specified and purchased at time of manufacture with OD×ID diametrical clearances of working barrel inside diameter and plunger outside diameter called running clearances common to the industry.

Then during the pumping life cycle of the installation fluid media and temperatures and percentage of solids plus others directly affect the overall leakage factor also called volumetric pumping efficiency of the high pressure downhole pump.

The examples are provided as simple baselines from which future operating conditions and operating characteristics of the adaptable surface unit to evolve from.

If weight transfer does not occur and weight does not come off the polished rod string being lowered it is an indicator that gas lock or severe gas interference is occurring thus preventing new ground fluid to enter the downhole pump.

When wellbore fluids are unable to enter the downhole pump and move past the traveling valve, the result is no new production fluids are lifted out of the wellbore during pumping. Alternatively, the well is simply pumped off, meaning there are no additional fluids to lift out of the wellbore.

Compression Ratio and Pump Spacing

Downhole pumps have pump spacing requirements. This is a reference to the total linear travel distances of the downhole pump and its traveling valve within the wellbore.

Specifically, pump spacing is defined as the linear distance between the traveling valve and the standing valve within the wellbore, with the polished rod assembly at the lowest position of downward travel (including over travel). This linear distance creates a cubic volume within the working barrel.

During gas interference pumping cycles the closer the traveling valve is before reversing direction upward provides a smaller cubic volume of dead space in the working barrel. This dead space provides a volume to compress the trapped gas interference media.

The smaller the dead space volume, the greater the ability to generate an increased working barrel pressure. This ability to generate higher working barrel pressures aid in forcing the traveling valve open thus allowing weight transfer to take place.

Knowing this available dead space volume along with the ability to make very small precision step changes autonomously based from actual measured pumping characteristics at the polished rod provides ability to alter the compression ratio of the downhole pump assembly automatically.

Full manual controllability of pump spacing would simply be addressed as inputting a value to a main controller specifying a dimension value for the bottom hole pump spacing. For example a well operating company may want to generically set the bottom hole spacing at two inches of clearance between lowest traveling valve over travel position versus the standing valve.

Rod Stretch Factor

The polished rod string assembly has an inherent stretching and compressing natural tendency as it operates the downhole pump in motion being lifted and lowered by the surface unit. The oilfield industry calls it over travel and under travel.

The polished rod string assembly is constructed and assembled of numerous components all of which affect its performance, some are listed here plus others not listed. The working variables are force required, total length, total weight, material tensile strengths, diametrical dimensions, number of threaded connections and condition of each threaded connection from top to bottom of the entire polished rod string assembly based upon each operating well installation as it was selected for that specific pumping application.

The above variables of polished rod string assembly all work together and contribute to the total amount of stretch factor the whole assembly experiences during the lifting and lowering motion plus the stretch factor changes as fluid loads are removed and then reapplied onto it. All during the natural course of lifting fluid from the bottom of the wellbore out the surface wellhead.

Stretch factor includes the total linear length changes the polished rod string undergoes while pumping. Over travel and under travel both are described as when the actual polished rod linear travel as measured at the wellhead does not match the traveling valve actual linear travel downhole. The differences are caused by the polished rod string assembly stretching and contracting under load both statically and dynamically.

Polished rod string "stretch factor" exists constantly while it is supporting its own weight plus the weight of the fluid column plus frictional and buoyancy forces acting to increase and decrease the combined loads being supported and created while dynamically being lifted and lowered by the surface unit.

While lifting it elongates and while lowering it compresses. The amounts of actual movements experienced downhole are difficult to calculate due to the vast number of variables involved such as taper construction details, overall weights, diameters, tensile ratings, length overall, number of threaded connections including torque values of all threaded connections acting together as one entity.

With the above cited variables concerning actual over and under travel movement comparison to the interpolated traveling valve distance versus the actual measured polished rod distance, there is one constant. Steel stretches and contracts based on given loadings. When the loads change so does the appropriate elongation and contraction of the steel itself, excluding temperature changes. Stated another way is if the loads didn't change the amount of over travel and under travel wouldn't change either, hence very repeatable.

It is the consistency of these changes that is important. Steel is extremely consistent at repeating the same stretch and contraction when the same load is applied or removed from it. This includes all moving steel that is used to lift and lower the polished rod string.

By accurately measuring and regulating the actual input force and input movement with a high degree of resolution and consistent time segments one is able to accurately predict total rod stretch factor for various measured and recorded polished rod load conditions. Meaning this allows for accurate and repeatable traveling valve over travel amounts for any given loading or average of loadings applied to the polished rod string.

Propagation Delay and Weight Measurement

When measuring a polished rod string total weight at the surface there is also a propagation delay time for the downhole force to travel up the polished rod string to be detected and measured at the surface, this is a variable which must be factored in.

Force is transmitted through steel at approximately the same as speed of sound in steel. These are common values known today also containing numerous variations, API-RP 11L uses 980,000 feet per minute in steel sucker rods for natural frequency calculations.

Today in the oilfield, measuring the weight of the polished rod string is typically done using either a horseshoe style transducer or polished rod style transducer. Both are common today and both have their pros and cons.

Horseshoe styles are typically sandwiched between the bottom of the rod clamps fixed to and supporting the weight of the polished rod string and the carrier bar hanging and connected to the bridle with the weight of the polished rod string squishing the horseshoe transducer producing an output signal representing actual load acting upon it.

Polished rod transducers attach differently to the polished rod, not being load bearing and typically are considered intermittent use. They are typically only installed when a manual dynamometer test is performed on the well operating system. They are typically not used in continuous operation load detection and reporting.

A third method is measuring the hydraulic load generated pressure of the lifting lowering linear actuator. It can be permanently mounted, protected from the weather and easily integrated into the hydraulic energy transfer system as well as the main control system that autonomously monitors and controls the surface unit operation. Also called work port pressure and is typically measured in pounds per square inch PSI units of measure.

Doesn't matter the type of weight sensing device as long as it is reasonably fast to react, sensitive to very small weight changes and has the ability to remotely relay an output electronic signal of adequate resolution to a main controller allowing load variation detections as they occur in real time to be monitored, processed and recorded for pumping process control usage.

The propagation delay is similar to the stretch factor in that the property of steel to transmit a force though it is very repeatable as long as the steel does not change the propagation time should not change over time. Loads may and do change downhole without warning.

By having fast accurate repeatable polished rod position and force a surface unit maybe configured and controlled autonomously to detect and alter its pumping process at the first sign of downhole pumping condition short comings in either falling weight transfer position or gas interference or any combination of both.

It would be Good Practice to Weigh the Polished Rod String

It would be good practice to be able to provide actual static and dynamic weights and measures with and without fluid loads and buoyancy factors present at any position within polished rod string total range of lifting lowering motion travel distances and velocities.

It would be good practice to know the polished rod position very accurately with a high level of resolution and consistency of measuring of said position where sample rates occur very fast and very consistently during the total motion as it is being lifted and lowered.

It would be good practice to know when polished rod string weight changes very accurately with a high level of resolution and consistency of measuring of said force or weight where sample rates occur very consistently during the total range of motion while it is lifted and lowered.

A way to perform this is upon initial commissioning of the well pumping system with the tubing string fluid level as low as possible and having the ability to move the polished rod string to any position and stopping to maintain position allowing the weight to be measured and recorded for future use.

Then incrementally lift and lower the polished rod string to a new commanded position and velocity plus many positions and velocities looking for variances from fully raised to fully lowered position of the polished rod string travel while simultaneously measuring and recording both the position and weight at high resolution of varying polished rod positions.

It is also very likely there to be various fluid level loads existing within the tubing string and the annulus while performing the above data recordings on a newly commissioned well and especially on existing wells with various fluid levels. By collecting the above known positions and weights or loads on the polished rod string assembly it would be possible to determine a baseline at that known operating condition(s) including total stroke movements of the polished rod and strokes per minute of the total pumping system at that time and under those specific well operating conditions.

If at a later date during well production the same testing process is done and comparing the two sets of position and load data points an estimated operating condition change downhole maybe provided.

Stated another way could be by comparing the multiple sets of position and load data points as the polished rod string is lifted and lowered at various total strokes and various strokes per minute during pumping one might be able to look for what is different and determine a new set of commanded operating control inputs to the surface unit attempting to elevate weight transfer position or reducing gas interference downhole thereby increasing or optimizing total well production.

One could also potentially detect gas interference and by changing the pump spacing or compression ratio the pump undergoes downhole one might be able to reduce or eliminate a gas locking condition.

Various Forces and Fluid Column Loads

The polished rod string assembly is exposed to multiple different forces as it is lifted and lowered operating the downhole pump. Some could be various frictions mechanical in nature as the moving assembly contacts the tubing string which it reciprocates in which could be caused by deviated wellbores, horizontal wellbores plus any other type of variant which may force contact of polished rod assembly and tubing string.

The polished rod assembly as it is being lifted and lowered by the surface unit experiences various fluid conditions within the tubing string inside diameter. These various fluid conditions provide lubrication and buoyancy of various amounts plus acting as fluid orifices with the OD (outside) to ID (inside) mechanical diametrical dimensions to the displaced steel volumes being lifted and lowered depending on fluid densities, solid materials present and percentages of solid materials which may or may not be present within the tubing string linear inside diameter volume.

The polished rod assembly supports and lifts the fluid column volume above the traveling valve to the surface to be produced out of the wellhead. Fluid column load is affected by pump diameter, tubing string diameter, rod string diameters, pump setting depth, pump inlet pressure, fluid being lifted, fluid density, percentage of solids and gases plus acceleration and deceleration forces to name but a few variables when it comes to determining actual weight load in pounds force.

Autonomous Weight Transfer Position Elevation

The autonomous pumping process control goal is simply achieving optimum rod pumping results using the least amount of prime mover energy. This results in the fewest downhole component failures and best use of input prime mover energy.

Having polished rod motion control abilities autonomously regulating the total pumping process including polished rod travel distance, lifting and lowering velocities, pump strokes per minute, and ability to stop and hold for any time duration at any position are imperative to elevate weight transfer position and rate of change.

Autonomous pumping process feedback signals required are real time absolute polished rod position detection with real time load monitoring of the actual weight suspended from the polished rod in addition to prime mover energy levels.

Combining the above motion controls with actual feedback operating conditions as measured at the surface enables a main controller to monitor actual pumping conditions occurring downhole then regulating the polished rod motions of future lifting and lowering pumping processes.

Having very fine resolution with consistent time cycle logging of the polished rod position as measured at the surface unit enables very precise mapping of downhole pumping conditions on each pump stroke.

Having abilities to average and compare these pumping results over a selectable number of pumping strokes offers the ability to average and make very small precise pumping process motion modifications while monitoring the pumping process for any measured changes both good and bad.

Rod pumping is a continuous operating process. Meaning the surface unit typically runs either continuously or for a specific amount of time before shutting off while allowing the well producing zone to normalize before resuming the pumping process.

The surface unit lifts and lowers the polished rod string based on input horsepower available and a somewhat known or expected pumping rate of the specific wellhead it is operating. Downhole conditions vary from well to well to well including ability for producing zone to release its trapped fluid media volumes, ambient conditions existing at the pump inlet and resulting ability for the downhole pump to actually transfer this fluid media to the surface.

The ideal downhole pumping cycle is illustrated below. This scenario includes the working barrel being filled fully or 100% with liquid fluid as the polished rod reaches its top of stroke. It is as follows:

As the polished rod string assembly including traveling valve begins the lowering motion, contacting the fluid level of the working barrel liquid fluid, pressure rises by immediately forcing the standing valve closed. The trapped fluid internal pump pressure continues rising in smooth but rapid manner.

Once this trapped working barrel liquid fluid pressure is higher than the fluid column load generated pressure, the traveling valve is forced open. The fluid column load or weight previously suspended above the traveling valve transfers to the tubing string being supported by the closed standing valve.

The weight has just come off the polished rod at a specific measured position and a specific rate of change. Both variables are measured and recorded in the main controller at the surface.

Having the traveling valve open and rod string traveling downward the previously trapped working barrel liquid fluid volume is now transferred through the open traveling valve and enters the production tubing string. Upon the next lifting stroke this newly acquired liquid fluid volume begins the lifting process to the surface eventually pumped out of the wellhead.

This was the ideal pumping process downhole and it rarely occurs. 100% liquid fluid is nearly non-compressible and is a great energy transfer mechanism. Gaseous media is highly compressible and is a poor energy transfer mechanism.

Gas interference affects the pumping process by adding compressible media into the working barrel trapped volume. This affects the rate of change during weight transfer. This affects total distance the traveling valve must move before pressurizing the working barrel trapped volume to a high enough level allowing weight transfer to occur.

Gas interference can be caused by creating too great of low pressure zone within the working barrel during pump intake. Meaning when the traveling valve is lifted faster than the pump inlet fluid can pass thru the open standing valve a lower pressure zone is created within the working barrel.

Fluids de-gas at reduced pressure levels. Meaning gaseous media is usually dissolved within liquid fluids and when subjected to a decreased pressure zone the fluids tend to release their entrained gaseous media. The rate of which the de-gassing occurs is directly proportionate to the reduced pressure level. The greater the pressure differential the faster the de-gassing process and vice versa. This gaseous media is now inside the working barrel intake stroke.

The pumping process can manage these variables by regulating total travel of the polished rod by only lifting far enough matching the liquid fluid inflow volume. Through reducing the lifting velocity and maintaining a constant polished rod velocity while lifting one may be able to limit the degasification process and still achieve full stroke travel of the polished rod at the surface. If the polished rod is commanded to stop for a selectable time amount at the top of the polished rod travel it would allow additional time for the liquid fluid passing through the open standing valve. All three of these listed scenarios are independent yet are combinable in various percentages learned while autonomously elevating the weight transfer position and decreasing the rate of change during the pumping process.

The pumping process is focused on the positive displacement pump cycle as it occurs downhole every stroke and how every stroke can be averaged over a selectable number of strokes or operating time frame. The surface knowledge of position and rate of change during weight transfer enables the main control to autonomously self-regulate its next pumping process motion command output solution by knowing what just occurred downhole on previous pump cycle or average of pump cycles.

The pumping process is ever changing based on measured conditions at the surface. Starting with the previous described ideal downhole pumping condition and as weight transfer position lowers and rate of change lengthens a possible beginning scenario could be simply reducing the constant lifting velocity and autonomously analyzing the next pump cycle or average of cycles result. Did WTP elevate? Did WTP rate of change decrease? If yes continue this pumping profile till WTP and rate of change alters again. If no then decrease lifting constant velocity again and re-analyze.

Another scenario could be as WTP declines and WTP rate of change increases further and if slowing the constant lifting velocity did not correct then add stroke reduction into the process. Did this autonomous adaption of surface unit motion cause a measurable change in WTP or rate of change logged at the surface? If it was a positive change continue at this pumping process and after an amount of pump strokes try increasing the total travel lifted. Did it make a positive or negative change to WTP position and or rate of change?

Another possible pumping variable is adding time dwell while at the top of polished rod lifting travel. If the working barrel is experiencing a low pressure zone from previous lifting intake stroke, simply adding a small segment of time, the low pressure zone may allow additional liquid fluid to be drawn through the open standing valve.

These three scenarios are merely examples of what the pumping process of the main controller manipulating the surface unit and reclaimed stored energy is able to accomplish while managing the entire pumping process. There are many more combinations and percentage of combinations which could and would be utilized.

Important note to remember this is an autonomous active pumping process. Meaning when a pumping variable has produced a positive result after a selectable number of pump cycles an increase in a pumping variable or multiple pumping variables should be attempted. This pumping process checks to see if the producing zone is able to increase its output further.

The results are easily verified by comparing before and after results previously described. This way the autonomous adaptable surface unit always attempts to increase well production. With the fall back plan is reducing its pumping displacement rate as before and continuing till next attempt of increasing its pumping displacement.

Stroke averaging of the acquired and stored pumping feedback data including polished rod position and polished rod load could be presented as a typical surface unit card currently used within industry today. By autonomously analyzing the working volume and shape of the typical surface card a main controller having the abilities to command a desired actual motion profile of the polished rod could affect changes in the total pumping process and total work cycle produced.

These changes would be easily determined if are positive or negative simply by comparing the weight transfer positions if elevating or declining and rates of change if decreasing or increasing.

A typical surface card shows lifting and lowering forces spread over total travel distances of lifting and lowering within a given pump cycle including time. This depicts a working shape represented as a typical surface card. This is commonly known in the industry.

If the main controller had the ability to measure the total volume of area within the surface card data, or resulting data points, and able to compare previous downhole pumping stroke cycle data points the main controller could autonomously determine if the total amount of work is reducing or increasing from stroke to stroke to stroke.

This pumping process of stroke averaging and comparing the total volume and shapes of the surface cards, or resulting data points, could be indicators of ambient pumping conditions changing downhole.

The surface cards produced are a visual reference of many data points of position, pounds force, velocity, direction of travel over time all stored as individual pump stroke cycles and averaged within the main controller. The surface cards could visually show the results of the main controller making pumping process changes attempting to elevate weight transfer positions in addition to decreasing rates of change for the weight transfer positions.

It is an objective of the present invention to provide a method for autonomous control of an oil or gas well down-hole pump surface unit to reduce gas interference and increase production.

It is a further objective of the present invention to provide a method for autonomous adjustment of one or more pump operation characteristics, including one or more of dwell time, polished rod travel, compression ratio, and pump cycle rate, for a rod pumped oil or gas well installation, based upon weight transfer position, rate of weight transfer, and stretch factor.

SUMMARY OF THE INVENTION

The method of the present invention is a method for autonomous control of an oil or gas well down-hole pump surface unit to provide for reduction of gas interference and a resultant increase in production and a reduction in maintenance and operation costs. The rod pumped well installation incorporates a surface unit, a production tubing string, a polished rod string assembly, and a down-hole pump assembly. The down-hole pump assembly includes a traveling valve and a standing valve. The method provides for the autonomous adjustment of one or more pump operation characteristics, including one or more of dwell time, polished rod travel, compression ratio, and pump cycle rate, for the rod pumped oil or gas well installation.

For a preferred embodiment of the method of the present invention, the method includes the autonomous determination of a weight transfer position from one or more weight transfer tests for one or more pump cycles of the down-hole pump; autonomous determination of a rate of weight transfer from the one or more weight transfer tests for one or more pump cycles of the down-hole pump as the polished rod travels down from a top of stroke to the weight transfer position; and autonomous adjustment of one or more of the pump operation characteristics for successive pump cycles of the down-hole pump installation based upon the weight transfer position and the rate of weight transfer.

For an alternative preferred embodiment of the method of the present invention, the method includes autonomous determination of a weight transfer position from one or more weight transfer tests for one or more pump cycles of the down-hole pump; autonomous determination of a rate of weight transfer from the one or more weight transfer tests for one or more pump cycles of the down-hole pump as the polished rod travels down from a top of stroke to the weight transfer position; determination of a stretch factor of the polished rod string assembly from a static polished rod string assembly stretch test and one or more dynamic polished rod string assembly stretch tests; and autonomous adjustment of one or more of the pump operation characteristics for successive pump cycles of the down-hole pump installation based upon the weight transfer position, the rate of weight transfer, and the stretch factor.

For a further alternative preferred embodiment of the method of the present invention, the method includes autonomous determination of a weight transfer position from one or more weight transfer tests for one or more pump cycles of the down-hole pump; autonomous determination of a rate of weight transfer from the one or more weight transfer tests for one or more pump cycles of the down-hole pump as the polished rod travels down from a top of stroke to the weight transfer position; and autonomous adjustment of one or more of pump operation characteristics, including one or more of dwell time, top of stroke, bottom of stroke, and pump cycle rate, for successive pump cycles of the down-hole pump installation based upon the weight transfer position and the rate of weight transfer.

DETAILED DESCRIPTION

Figure 1:
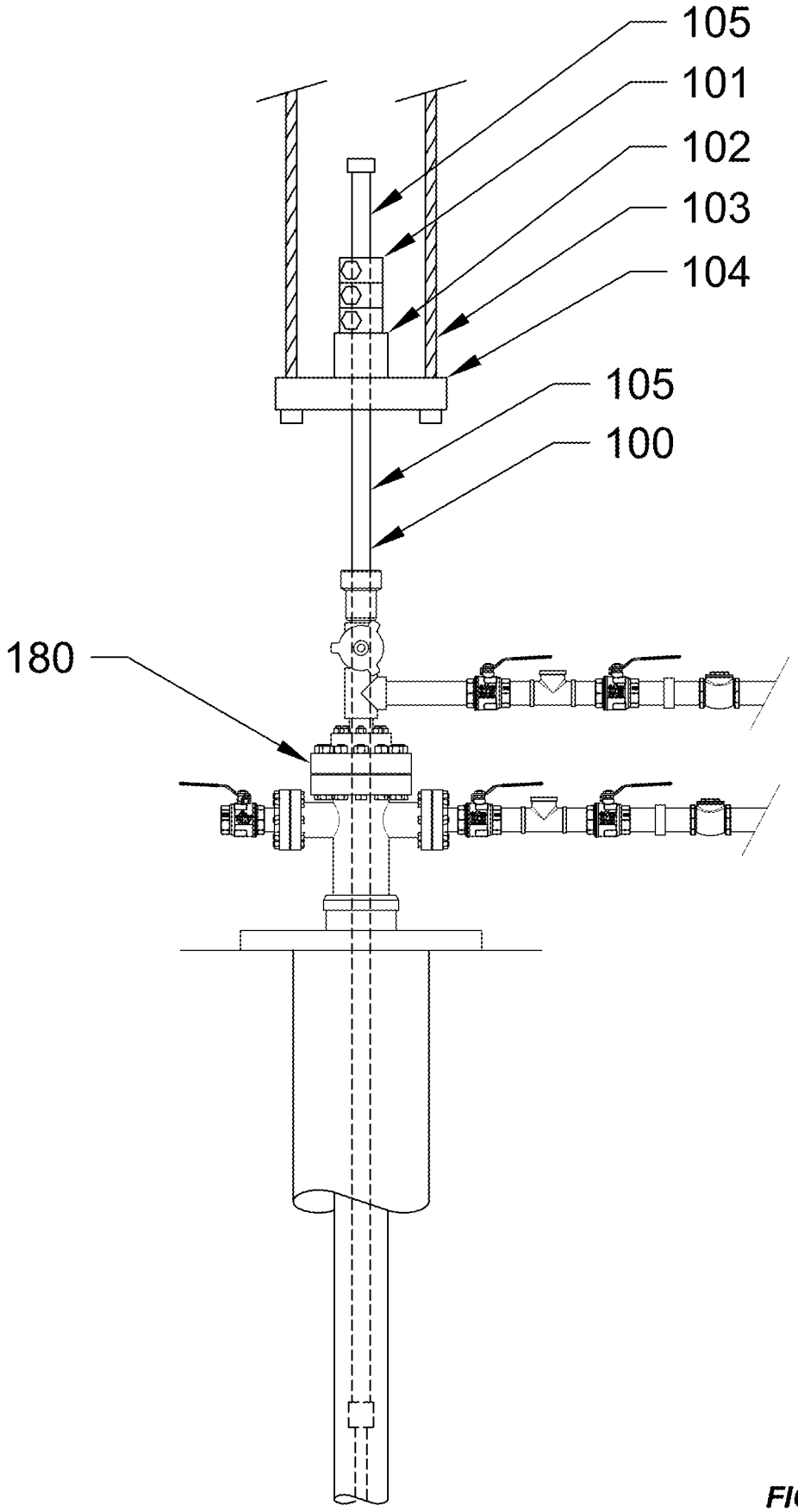
FIG. 1 is an elevation view schematic of an oil or gas surface unit interface and wellhead.
Figure 2:
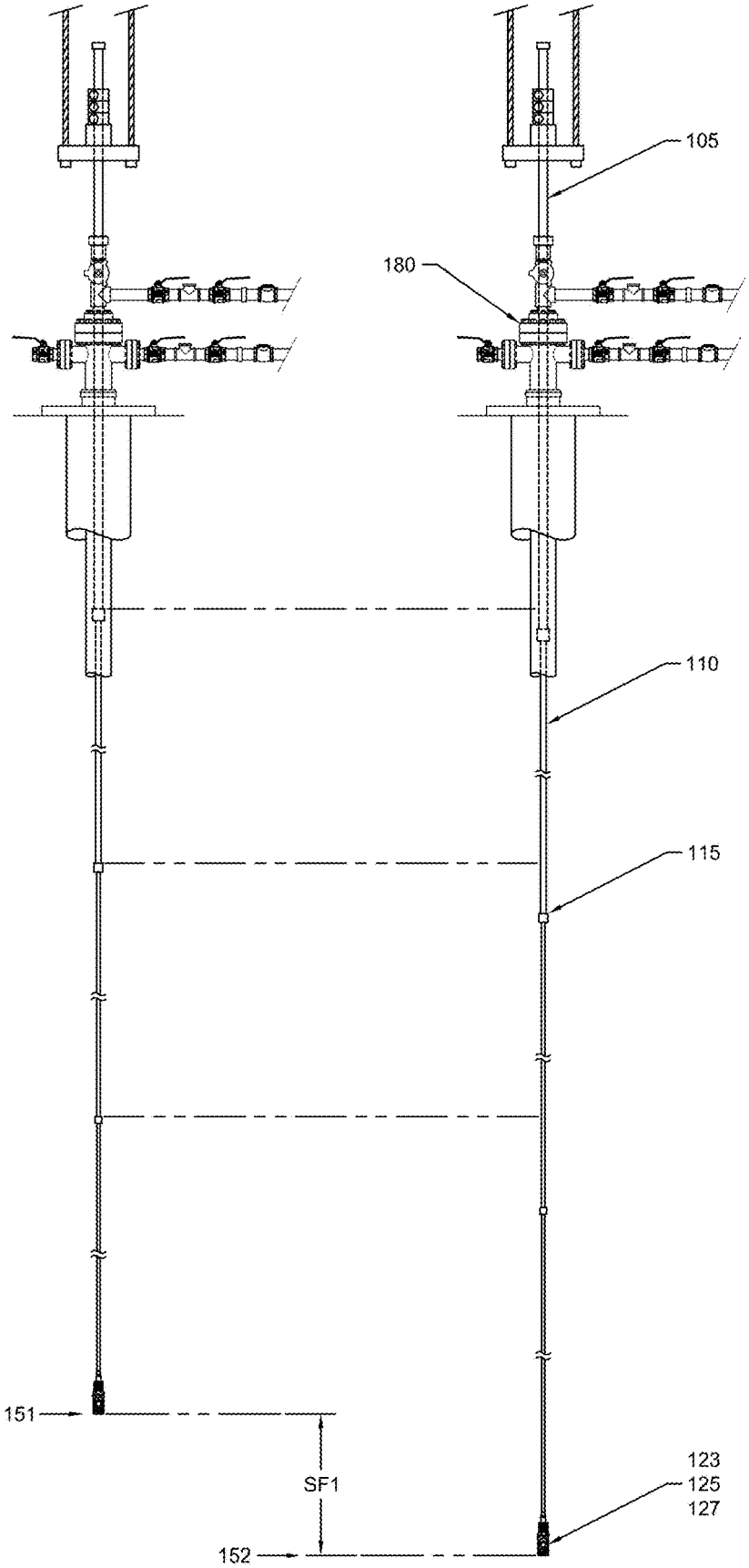
FIG. 2 is an elevation view schematic of the surface unit interface and wellhead of FIG. 1 and a polished rod string assembly extending into the well and illustrating a polished rod string assembly stretch factor.
Figure 3:
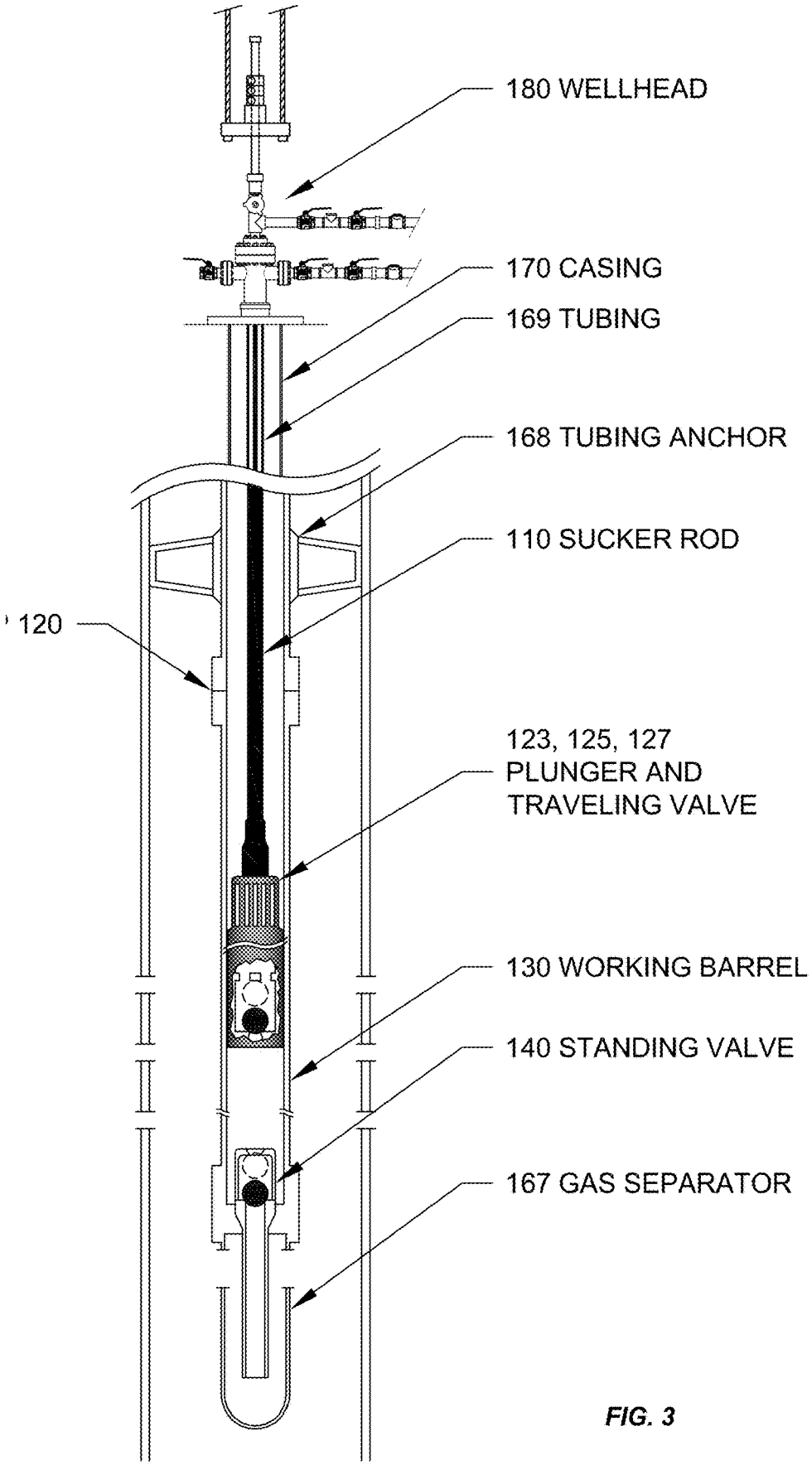
FIG. 3 is an elevation view schematic of the surface unit interface and wellhead of FIG. 1 with the polished rod string assembly of FIG. 2 and an enlarged elevation view of the downhole pump.

Referring to FIG. 1, FIG. 2 and FIG. 3, polished rod string assembly 100 consists of the polished rod 105, sucker rods 110, couplings 115 threaded together forming a long elastic energy transfer device transferring surface energy to the downhole high pressure positive displacement plunger pump 120, also known as the downhole pump 120. The moving portion of the downhole pump 120 is called the traveling valve assembly 123. It consists of two moving sub-assemblies the plunger 125 and the traveling valve check valve 127.

The traveling valve assembly 123 reciprocates up and down within the inside diameter of the downhole pump working barrel 130. The working barrel separates the traveling valve assembly 123 from the stationary standing valve assembly 140. The working barrel 130 is the downhole pump displacement chamber during the pumping process.

Figure 4:
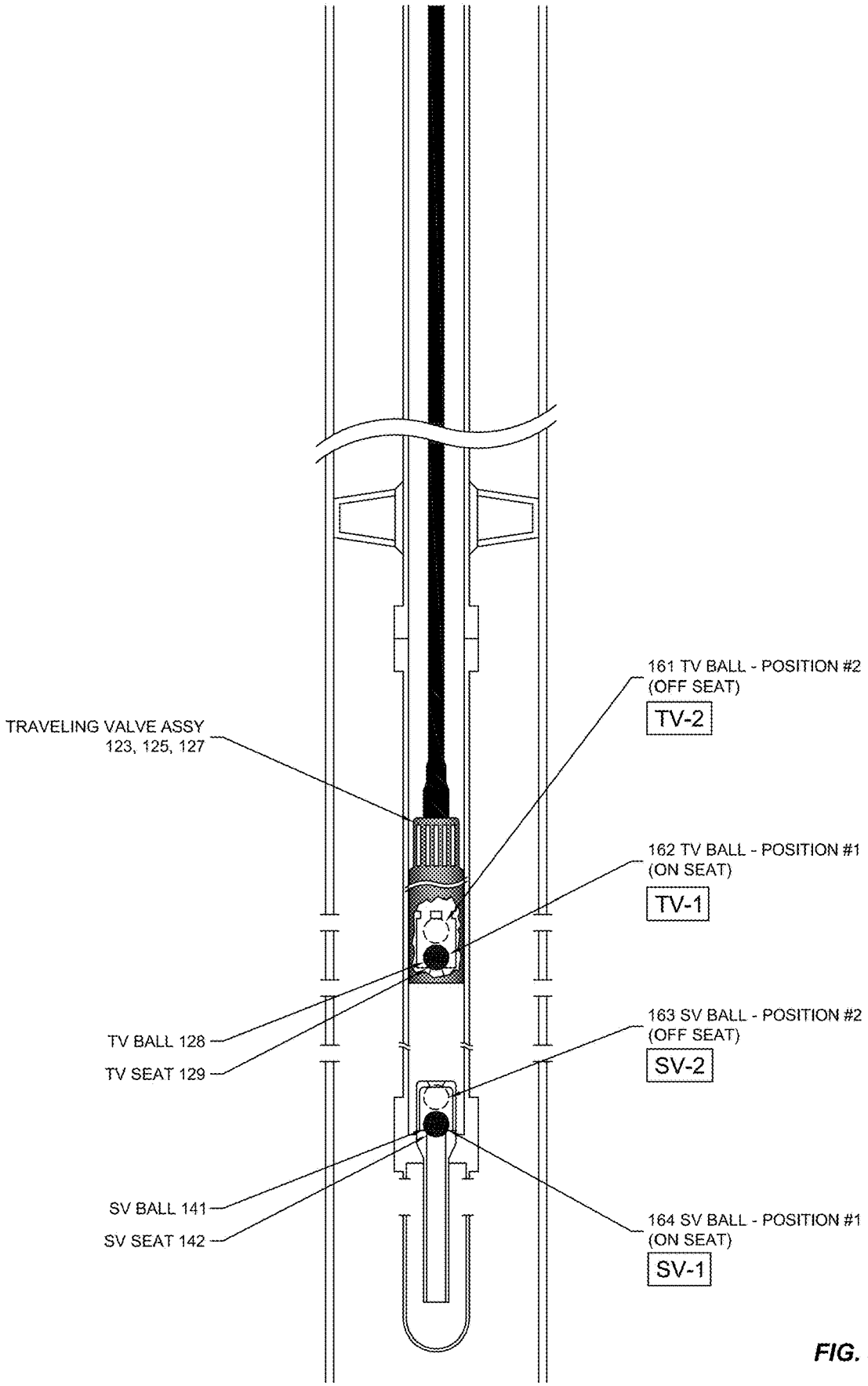
FIG. 4 is an elevation view schematic of the downhole pump.

Referring also to FIG. 4, the mobile traveling valve assembly 123 is comprised of two sub-assemblies the plunger 125 and the traveling valve check valve assembly 127. The traveling check valve consists of two parts. The moveable ball 128 and the stationary seat 129 and are considered a matched set. The stationary seat 129 does move but moves in unison with complete traveling valve assembly 123 hence considered stationary in relation to freely moving ball 128.

The stationary standing valve assembly 140 is permanently mounted to the production tubing string 169 within the wellbore and typically does not move when properly anchored. The standing valve assembly 140 is comprised of a moveable ball 141 with stationary seat 142 also a matched set.

When the balls are off their respective seats the valves are considered open. When the balls are forced into their respective seats from fluid differential pressure acting upon their surface areas, the valves are considered closed. When the valves are open they allow fluid media to pass both directions. When the valves are closed they do not allow fluid media to pass except for the volumetric leakage. The individual volumetric leakage of traveling valve is 123L and the standing valve is 140L.

During the pumping process the polished rod string assembly 100 is lifted and lowered by the surface unit. The surface travel of the polished rod 105 is typically measured in inches.

One lifting and lowering motion traveled a specific distance within a specific time duration is considered one stroke or cycle. The most common block of time duration is one minute, hence strokes per minute. The lifting velocity versus the lowering velocity are the speeds which the polished rod 105 travels a specific distance upwards and downwards within one stroke/cycle.

Figure 5:
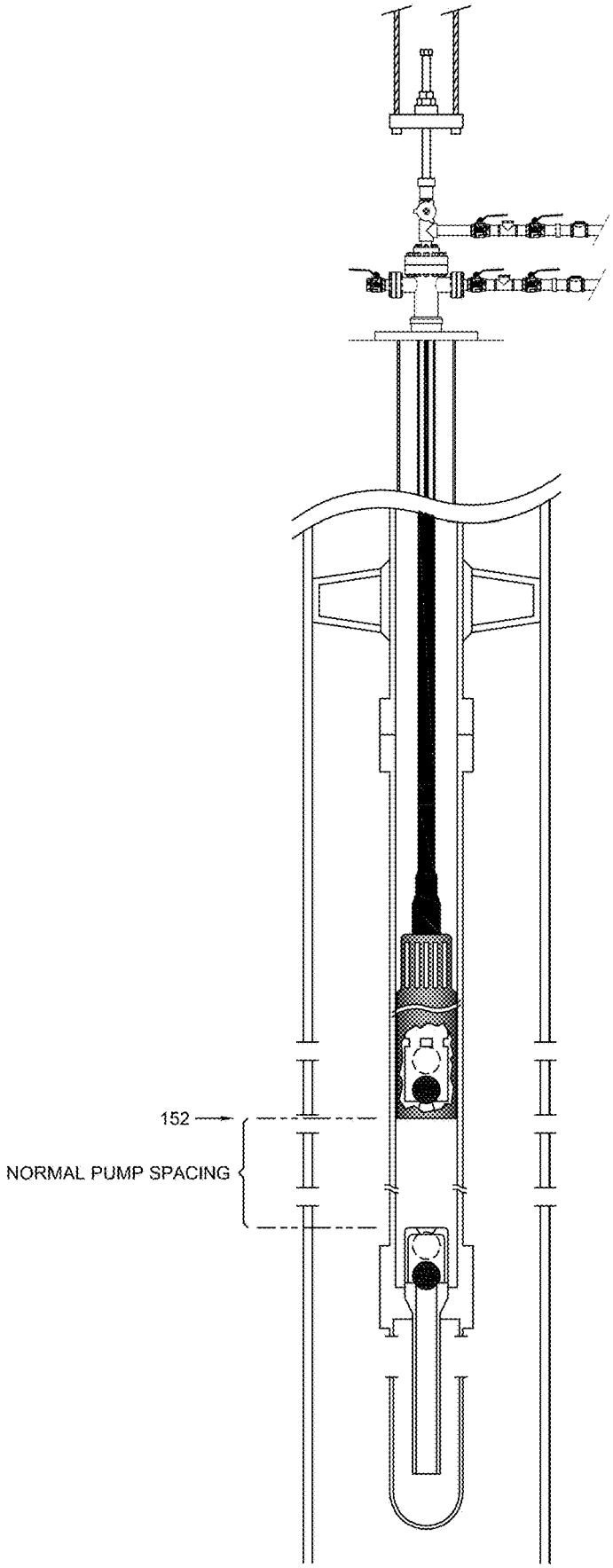
FIG. 5 is an elevation view schematic of the surface unit interface and wellhead of FIG. 1 with the polished rod string assembly of FIG. 2 and an enlarged elevation view of the downhole pump illustrating normal pump spacing between the traveling valve and the standing valve at bottom of stroke.
Figure 6:
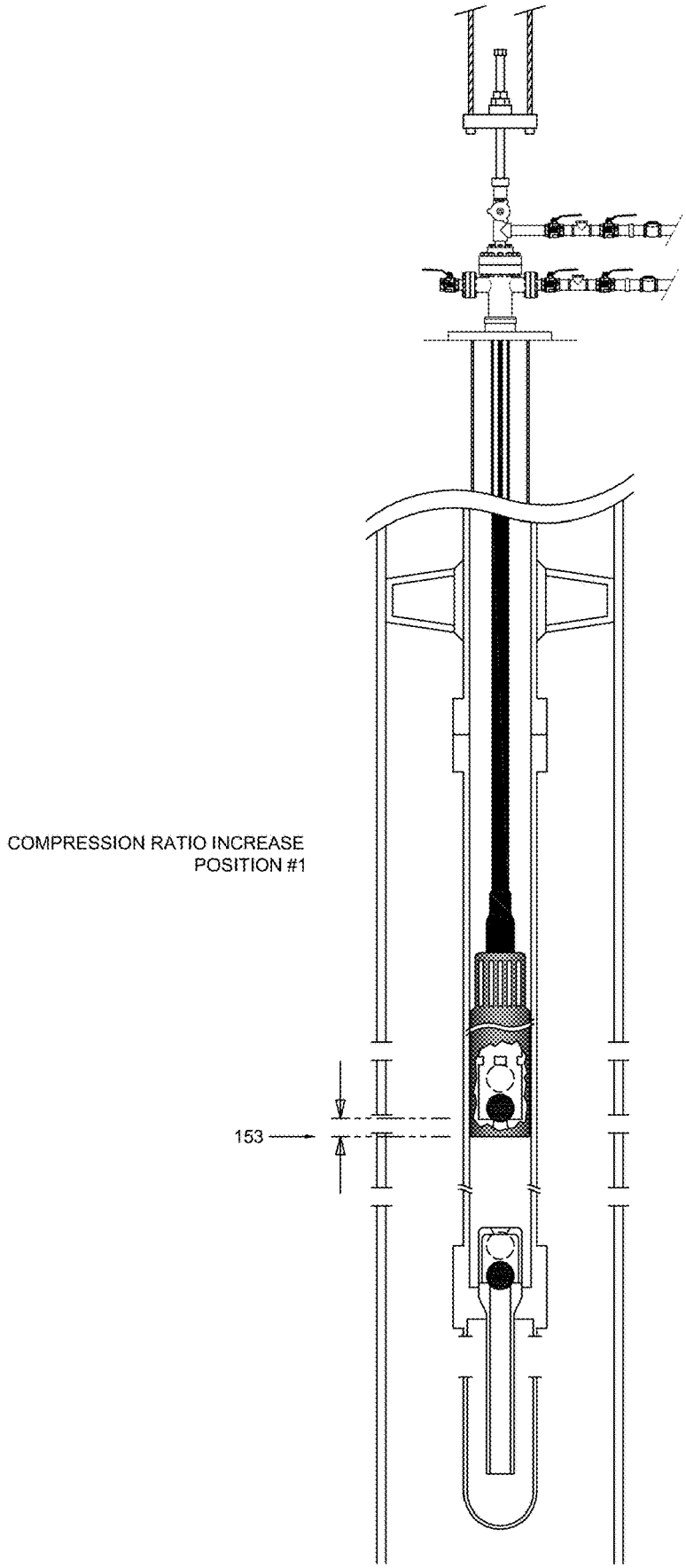
FIG. 6 is the elevation view of FIG. 5 further illustrating lowering of bottom of stroke and a resultant increase in the compression ratio.
Figure 7:
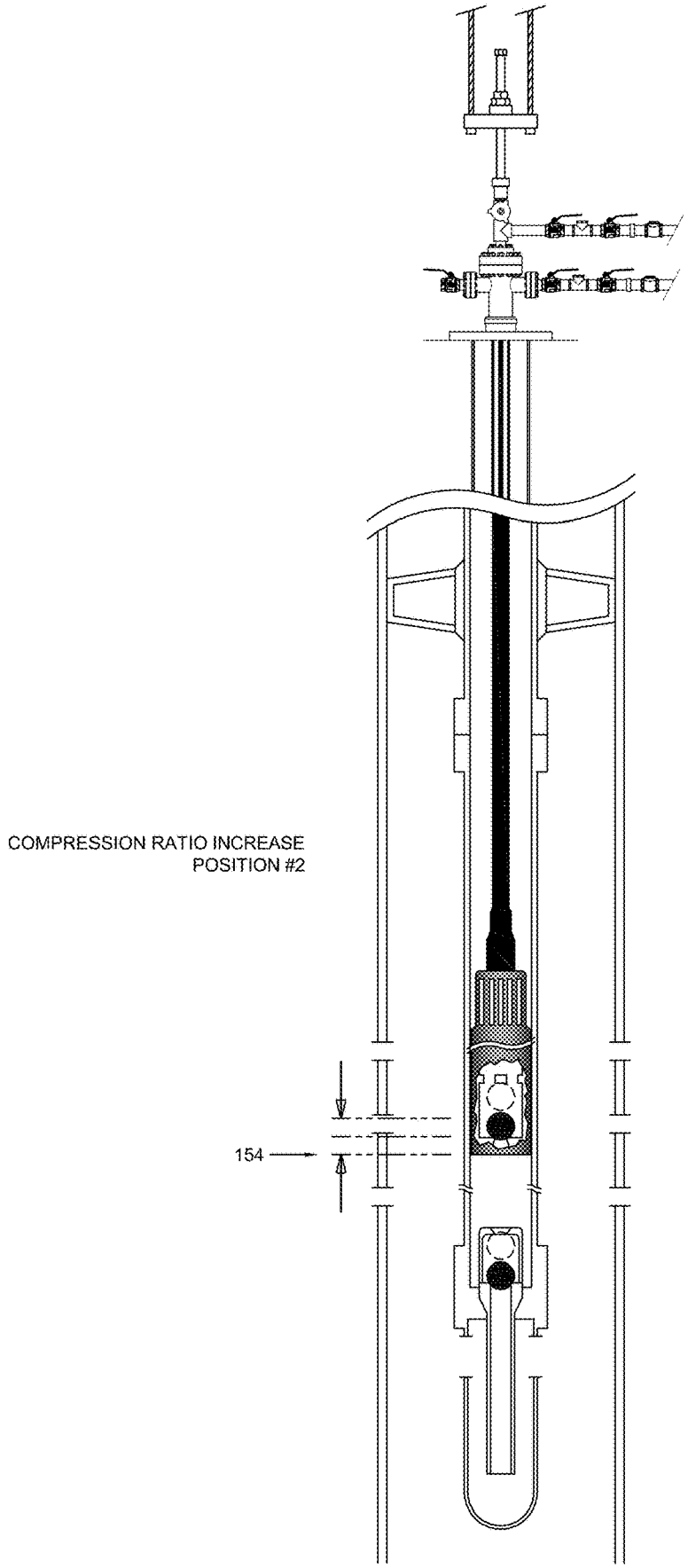
FIG. 7 is the elevation view of FIG. 6 illustrating a further lowering of bottom of stroke and further increase in the compression ratio.
Figure 8:
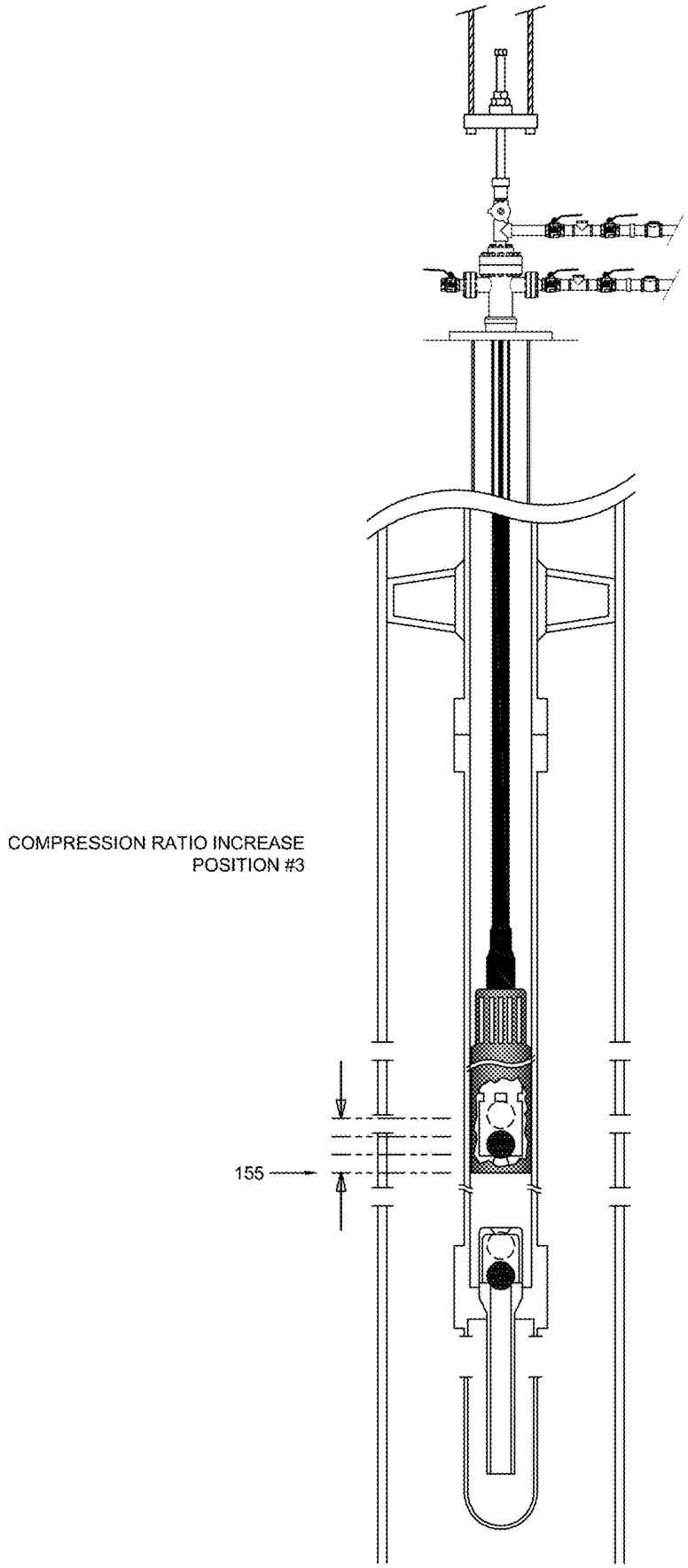
FIG. 8 is the elevation view of FIG. 7 illustrating a still further lowing of bottom of stroke and still further increase in the compression ratio.
Figure 9:
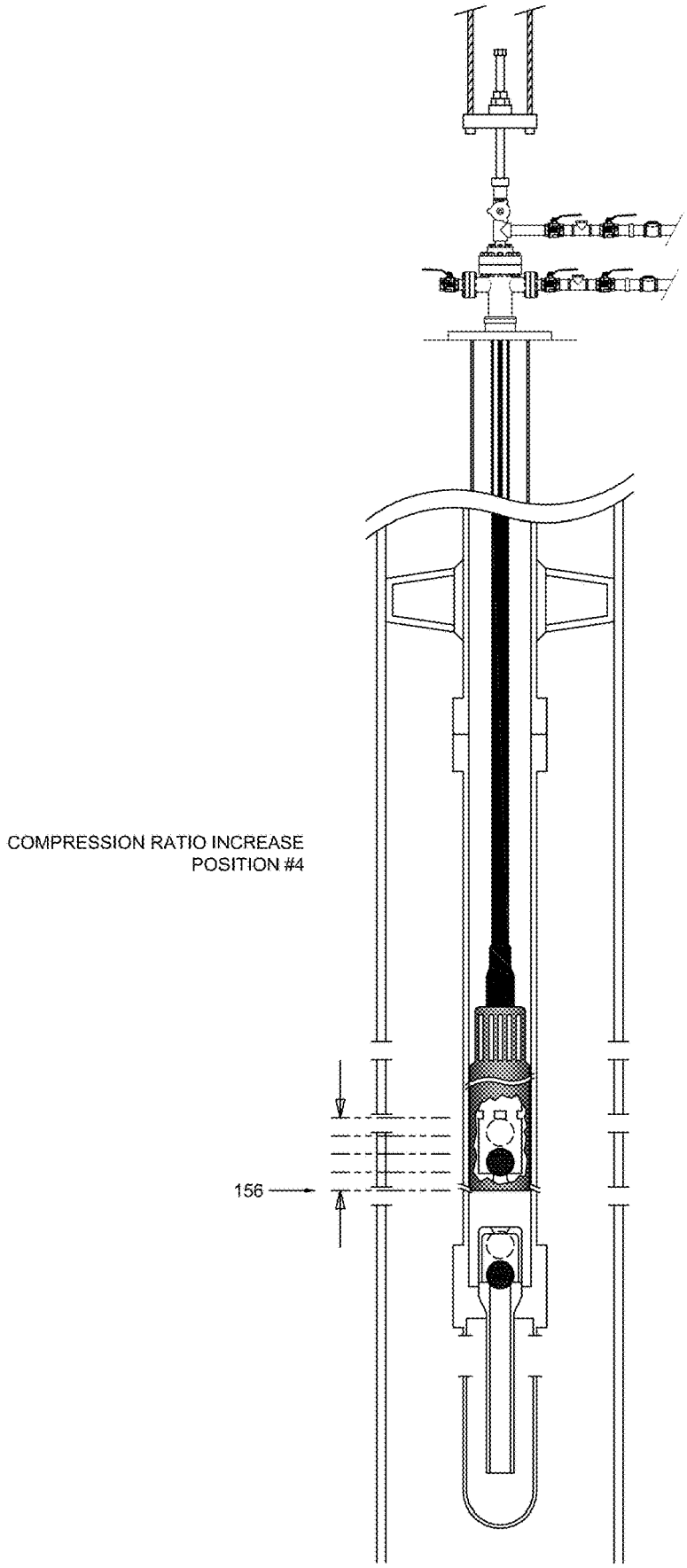
FIG. 9 is the elevation view of FIG. 8 illustrating an even further lowering of bottom of stroke and still further increase in the compression ratio.

Referring also to FIG. 5 and again to FIG. 2, the wellhead 180 has the polished rod assembly 100 protruding from the wellhead and reciprocated up and down. The traveling valve 123 and the standing valve 140 are mechanically spaced apart at the bottom of the well.

They are manually adjusted at time of installation and the spacing remains the same till mechanically readjusted at the surface. The over travel and under travel of the traveling valve 123 is estimated during assembly of the wellbore installation. The lifting velocity and lowering velocity are controlled by the surface unit while pumping the well.

Rod pumping surface units commonly use rod pump controllers called pump off controllers, run timers plus other names and types. All basically do the same thing reducing strokes per minute or run time or both while the well is subject to fluid pound, this is commonly known today. Run timers simply operate on a selectable time on versus selectable time off. Both types regulate their surface unit pumping characteristics without human observation or attendance locally onsite.

Various pump off controllers sold by numerous suppliers typically have a means of measuring a gross position of the polished rod assembly 100 and a means of detecting weight transfer position occurring downhole during the normal operation of the downhole pump 120.

Some sophisticated pump off controllers may be able to detect various routine occurrences at the downhole pump 120 such as falling weight transfer position which could be caused by decreased pump liquid fluid infill during intake portion of the pump cycle. Some may be able to detect various forms of gas interference within the downhole pump 120. This is commonly known today.

Some sophisticated pump off controllers may be able to regulate the electric motor operating RPM which affects surface unit strokes per minute based on rising or falling weight transfer position.

Or maybe able to selectively switch the prime mover on or off for time elapsed cycles allowing the well fluid volume to gather additional volume of ground fluid above the pump inlet enabling the downhole pump 120 to continue pumping while not fluid pounding.

Fluid pound is the industry term used to describe the downhole pump 120 not being full of liquid fluid during its compression portion of pumping cycle. This is commonly known today.

All the above details and descriptions are well known and commonly practiced in today's upstream oilfield sector.

The downhole pump 120 stroke length and its slide ably connected traveling valve assembly 123 are also in a fixed travel distance ratio of surface travel distance to downhole travel distance and velocity per every complete cycle of the downhole pump 120 regardless what the pump off controller is able to detect.

If the ground fluid column cannot fully fill the void or pumping chamber created during the pump intake cycle the entire pump intake volume may be subjected to a pressure reduction level causing the fluid to de-gas further and producing additional gas interference issues during the compression cycle.

The pumping process is transferring surface unit energy and direction of travel to the downhole pump 120 during operation while monitoring weight transfer position and rate of weight transfer change.

Pumping process always attempting to elevate the detected weight transfer position and decrease the rate of change while pumping through autonomously adjusting the pumping motion profile.

The motion profile of polished rod string 100 receives motion control energy of various levels that produce lifting and lowering. The motion profile includes polished rod travel distance, strokes per minute, lifting velocity, lowering velocity plus having the ability to stop and hold for specific time dwell XXX seconds at any position commanded, being determined autonomously thru measuring weight transfer position of polished rod 105 and rate of change in load supported by polished rod 105 thru polished rod transducer 102 or other means to calculate load hanging beneath polished rod 105 while pumping improves overall efficiencies while producing well.

During rod pumping operations polished rod assembly 100 undergoes total travel distance length changes as compared to polished rod 105 end and traveling valve 123 end actual travel deviations. The polished rod travel distance being very precisely measured is position command able and a constant pumping attribute which effectively does not change in comparison to actual traveling valve motion differentials due to external forces during the course of rod pumping a typical oil or gas well.

Traveling valve 123 actual travel distances change due to the natural lengthening and shortening when applying and removing external forces upon a long slender polished rod assembly 100 in tension, this is called stretch factor SF1.

These travel differences are commonly known within the oil industry today, called over travel and under travel. Until now these travel distance variations were not able to be autonomously and dynamically managed or utilized while rod pumping an oil or gas well installation.

When gas interference occurs at the downhole pump 120 it can drastically change total liquid fluid volumetric efficiencies of the downhole pump and hydrocarbon output at wellhead 180. If bad enough can actually prevent the liquid fluid volumetric pumping action from occurring when the traveling valve does not open during the compression down stroke.

Having the ability to modify the compression ratio of the downhole pump autonomously while pumping based on varying well conditions as measured at the polished rod 105 could drastically improve the overall pumping efficiency and profitability of the oil or gas well.

Stretch factor SF1 comes into play while determining actual traveling valve 123 travel and position downhole in relation to standing valve 140. The closer traveling valve 123 is to standing valve 140 during compression stroke while pumping creates a higher compression ratio when attempting to correct for gas interference problems.

Downhole pumps 120 are installed within the well having initial pump spacing, as defined as the linear travel distance between the standing valve 140 and the expected lowest position of the dynamically lowered traveling valve 123 while pumping.

This distance is currently manually calculated, measured and adjusted at the surface with polished rod clamp(s) 101 placements being manually calculated and measured then fixed to a specific position on the polished rod 105.

The calculation includes the expected rod stretch from the hanging force of the steel and liquid column loading being supported by the carrier bar 104. The distance is a calculated dimension based on polished rod string 100 construction details, all material yield values, all dimensions, all lengths and expected fluid loads while pumping. This is common industry practice today.

When downhole pump liquid fluid intake is high resulting weight transfer occurs at or near the top of polished rod travel after direction change. Upon starting the lowering direction when pump liquid fillage percentage is high and fluid density is high and weight transfer occurs quickly then it is commonly accepted that downhole pump 120 has a high percentage of high density liquid fluid fillage within working barrel 130. This scenario is ideal.

If weight transfer does not occur immediately upon polished rod string 100 lowering and if weight transfer loading as measured by polished rod transducer 102 or other means to calculate load hanging beneath polished rod string 105 slowly changes versus quickly changes then one scenario is likely the downhole pump 120 is suffering from gas interference.

Which could mean the pump spacing was initially adjusted for normal liquid fluid pump media fillage but now gas is interfering which is highly compressible media and resulting pump spacing is now set at too great of measured distance between traveling valve 123 and standing valve 140. This is one common well known scenario dealt with every day in the upstream oilfield.

During the course of rod pumping an oil or gas well it is a common event to have gas interference occur at the downhole pump 120, and to detect gas interference, stretch factor SF1 becomes relevant.

Having the ability to autonomously adjust the compression ratio live while pumping based upon weight transfer position and rate of change as measured at polished rod transducer 102 or other means to calculate load hanging beneath polished rod 105 in determining the load suspended via polished rod 105 while pumping provides the apparatus and method of combating and reducing gas interference problems.

Polished rod string 100 has a physical length being supported and positioned with rod clamp(s) 101 and carrier bar 104. This gross positioning of polished rod string in relation to known standing valve 140 position must be physically adjusted initially at the surface to allow potential contact downhole of traveling valve 123 and standing valve 140.

This contact is called tagging and is a well-known and practiced oilfield technique of defeating severe gas interference. However, it has severe limitations including all manual adjustments at the surface. These adjustments typically requiring heavy lift equipment and man power to make contact possible. The resulting force of impact is difficult to manually adjust for with rod stretch and dynamic changing loads which occur while pumping.

A surface unit may provide an easy and safe method to move, position and hold polished rod 105 on command. This allows a human to safely stack off the polished rod string 100 by using extra polished rod clamp(s) 101 be added below the carrier bar thus unloading the carrier bar 104.

This technique of unloading or stacking is a common oilfield procedure but previously required heavy lift crane or some other apparatus to lift and support the weight of the polished rod string 100 off the carrier bar 104.

Surface unit is commanded to lift the polished rod string 100 a manually determined amount, typically several feet up off of full down position and held stationary. A human manually and securely attaches an additional polished rod clamp(s) 101 onto polished rod 105 slightly above top of wellhead or wellhead support to carry the load.

Surface unit is commanded to slowly lower polished rod string 100 allowing additional installed polished rod clamp (s) 101 to contact top of wellhead or wellhead support taking full weight of the polished rod string 100, thus unloading the bridle 103 and carrier bar 104.

The original installed polished rod clamp(s) 101 are then repositioned, lowering expected traveling valve 123 furthest down stretched position, thus allowing contact of traveling valve and standing valve downhole. The procedure is reversed, reloading the bridle 103 and carrier bar 104 with the polished rod string 100 and well is now prepared to begin the gas interference detection and abatement pumping process.

The new pumping process will have numerous actual procedures, one is detailed here. Surface unit initially elevates and holds polished rod assembly 100 stationary against gravity with traveling valve 123 near but not at furthest down position.

The stationary position being registered and transferred for position recording along with polished rod transducer 102 output or other means in determining pounds load also transferred. Polished rod string 100 is then lowered slowly till pounds force change is detected in polished rod transducer 102 output or other means. The traveling valve 123 is now in contact with standing valve 140.

The position of polished rod 105 where polished rod transducer 102 output or other means detects a load change is physical indication where traveling valve 123 bottom position is while moving slowly downward.

Most likely the polished rod string will have some fluid load on it due to high probability of traveling valve 123 not opening during prior pumping actions so fluid load of some value will most likely be present and rod string stretch of some amount will be present. This is static traveling valve position 151.

Using static traveling valve position 151 in conjunction with known estimated total rod stretch per the well installation records, bills of materials and manually calculated stretch amounts previously described provides for an initial position of polished rod 105.

Knowing the static traveling valve position 151 and comparing with calculated total rod stretch allows a differential position of polished rod 105 to be used as a starting point for further pumping operations.

Once traveling valve position 151 is interpolated for a static non-pumping position.

The lifting velocity and lowering velocity along with polished rod transducer 102, or other means in detecting when or if a change in the suspended load is detected all being closely regulated and monitored.

Through the slow lifting and lowering closed loop position cycling of polished rod 105 and by adding additional velocity into the motion, rod stretch is accumulating; meaning traveling valve 123 will ultimately have a lower bottom of stroke.

This difference of travel measured at the surface and when force changes monitored from polished rod transducer 102, or other means is detected.

This process is duplicated several times to verify results are the same at the identical slow rates of lifting velocity and lowering velocity while comparing the resultant polished rod position in duplicating the detection and recording of new traveling valve position 151.

This position will change when polished rod string 100 is operated at normal pumping speeds and loads. This is where stretch factor SF1 and traveling valve position 152 are now factored in.

Stretch factor SF1 is a dynamic value made up of polished rod string 100 components, yield ratings, diameters, overall lengths, number of threaded connections, quality of the torqued threaded connections, fluid column loads, velocity lifting, velocity lowering along with strokes per minute of polished rod assembly 100 while pumping well.

These dynamic values are difficult to reliably mathematically calculate due to the many variables that may or may not be consistent with published values used in the numerous mathematical methods of determining actual polished rod string 100 total dynamic stretch values under loaded conditions downhole.

Meaning the actual lowest position of traveling valve 123 while pumping at operating speed is difficult to calculate but through this empirical process of comparing traveling valve position 151 and 152 surface unit is able to repeat ably position polished rod 105 with reliable downhole results by using the measured actual stretch factor 151:152 ratio and relying on the steel components repeatable consistencies unless there is a failure of the components installed in polished rod string 100. When a failure is detected a notification in the prescribed manner is dispatched.

This process should be done more than once at different lifting and lowering velocities to determine stretch discrepancies at new velocities. The stretch factor SF1 will change at higher inertia speeds, hence more stretch and resulting over travel and under travel downhole will change. Meaning the absolute bottom position of travel valve 123 will increase further downward due to increased rod string stretch factor SF1.

This process should be done at desired pumping strokes per minute and velocities to again determine what actual traveling valve position is at furthest down position where load changes can be registered. The goal is to find the furthest rod string stretch factor SF1 position 152 at rated load on polished rod string 100 at desired pumping strokes per minute using desired travel velocities.

Knowing the measured positions of traveling valve 151 and 152 differences allows surface unit to autonomously alter downhole pump 120 spacing forcing weight transfer to occur on each gas interference compression cycle.

Surface unit being able to produce very accurate, repeatable and high resolution positioning and detection of loads on polished rod string 100 provides benchmarks for reference with the variability of actual traveling valve 123 furthest downward position dynamically positioned at speed and force while pumping as a reliable means of knowing stretch factor SF1 position with high degrees of reliability because the steel physical properties of polished rod 100 will not change downhole while pumping.

When a position or force outside a predetermined motion parameter does change while pumping a change from previous stroke or stroke averages of position and force has occurred within the well and a notification is autonomously dispatched. If a severe parameter change occurs a safe shut down procedure is performed.

Surface unit having the ability to autonomously and dynamically change the downhole pump 120 compression ratio based on where and how the traveling valve 123 opens provides the opportunity to autonomously regulate the pumping process as gas interference is detected while pumping.

Referring also to FIGS. 6-9, these compression ratio steps are illustrated in traveling valve positions 153 thru 157 but in reality the steps could be many more providing a higher degree of resolution downhole. The continued lowering of traveling valve 123 is for the purpose of developing increased internal pump pressure which forces the traveling valve open thus allowing new volumetric liquid fluid to enter working barrel 130 to continue pumping.

Figure 10:
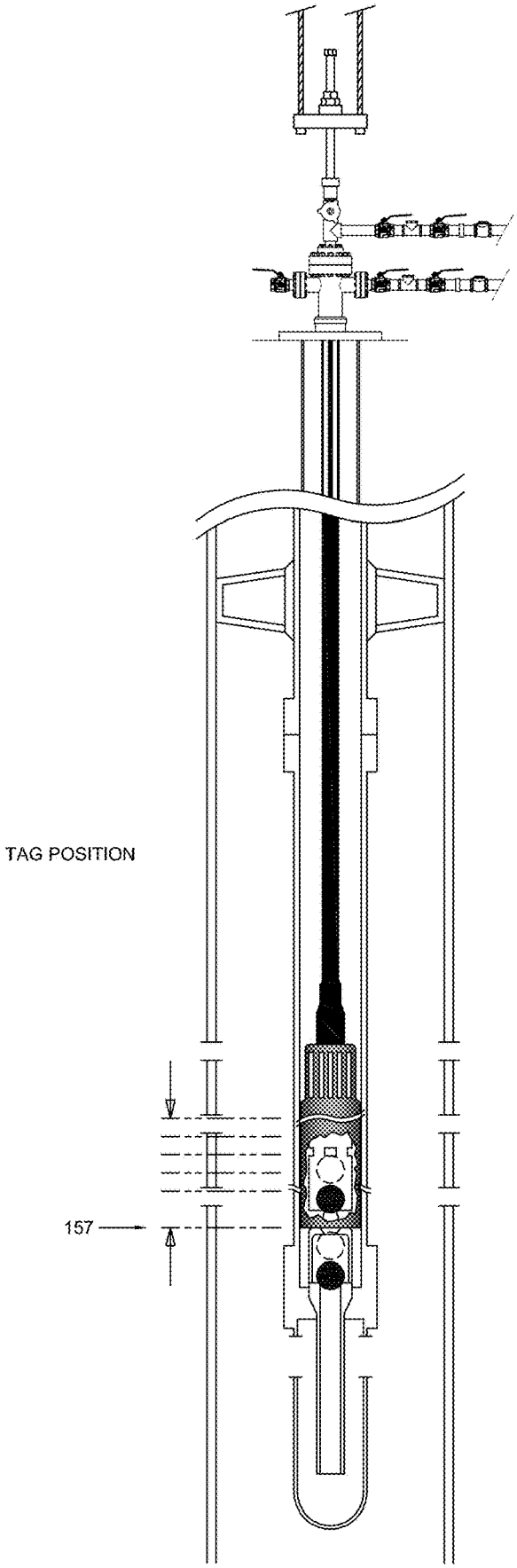
FIG. 10 is the elevation view of FIG. 9 illustrating further lowering of the bottom of stroke to the tag position.

Referring also to FIG. 10, tagging the traveling valve 123 to standing valve 140 is an industry known process in mechanically forcing by impact the traveling valve 123 open. By forcing the traveling valve 123 to open the trapped working barrel 130 volume content enters the tubing string 169.

Surface unit in compression ratio modifications while pumping allows the creation of traveling valve position 157 also called auto tag position. Having the ability to know the dynamic SF1 stretch factor amount and repeat ably and incrementally alter the polished rod 105 position while pumping allows traveling valve 123 to be precisely and repeat ably lowered to eventual contact with standing valve 140. The impact force is controllable by the command able incremental stroke travel dimension changes of polished rod string 100.

The results of success are easily determined. If while pumping previously the traveling valve did not open preventing weight transfer to occur and attempts of increasing the compression ratio still had not produced weight transfer.

Then further incremental lowering of traveling valve upon reaching contact with standing valve 140, in small steps, limiting the impact force, then forces open the traveling valve 123 allowing weight transfer to occur, then success is achieved with a command able variable minimal impact force all easily verifiable.

Further this means that propagation time delays experienced from detecting loads at the surface being generated at opposite end of the long polished rod string 100 plus related natural frequency of movements and associated harmonics from reciprocating motions are more accurately portrayed at the surface and used for pumping process refinements and averages of command able future pump stroke cycles.

In view of the disclosures of this specification and the drawings, other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A method of adjusting one or more pump operation characteristics for a rod pumped oil or gas well, the rod pumped oil or gas well comprising a surface pumping unit, a production tubing string within a wellbore, a polished rod, a sucker rod string residing within the production tubing string below the polished rod, and a down-hole pump, with the down-hole pump having a traveling valve and a standing valve within the wellbore, and the method comprising:

providing a controller;

providing a position sensor and a load cell associated with the polished rod;

using the surface pumping unit, reciprocating the polished rod, the sucker rod string, and the traveling valve together in order to pump fluids from the wellbore;

using the position sensor, monitoring a position of the polished rod during the reciprocating, and sending signals to the controller indicative of the position of the polished rod;

using the load cell, monitoring load on the polished rod during the reciprocating, and sending signals to the controller indicative of the load on the polished rod; and using the controller, associating positions of the polished rod and loads on the polished rod as a function of time during the reciprocating;

determining a position of the polished rod when a weight transfer is detected by the load cell during one or more pump cycles of the down-hole pump, recorded as a weight transfer position when the traveling valve is forced open;

recording changes in load on the polished rod as the polished rod travels from a top-of-stroke down to the weight transfer position during the one or more pump cycles of the down-hole pump; and adjusting one or more of the pump operation characteristics for successive pump cycles of the down-hole pump based upon the weight transfer position and the recorded changes in load on the polished rod.

2. The method of claim 1, further comprising:

upon beginning production, using the surface pumping unit, lowering the polished rod at the surface pumping unit, thereby lowering the connected sucker rod string and the traveling valve until the traveling valve contacts the standing valve and weight loss is detected by the load cell;

continue lowering the polished rod until stretch is taken out of the sucker rod string;

using the position sensor, identifying the position of the polished rod where stretch is taken out of the sucker rod string as a first static position;

using the surface pumping unit, raising the polished rod at the surface pumping unit, thereby raising the connected sucker rod string and the traveling valve;

using the position sensor, identifying the position of the polished rod where weight is again detected by the load cell and stretch is fully returned to the sucker rod string as a second static position;

identifying the linear difference between the first static position and the second static position as a static stretch factor of the polished rod string; and autonomously adjusting the position of the polished rod at the surface based on the static stretch factor to avoid the traveling valve tagging the standing valve at a bottom-of-stroke during the pump cycles.

3. The method of claim 2, further comprising:

obtaining one or more of a yield rating, a polished rod diameter, a polished rod length, a diameter of the sucker rod string, a number of sucker rod threaded connections, a fluid column load, a polished rod lifting velocity, and a polished rod lowering velocity as additional stretch factors;

adjusting the static stretch factor based upon two or more of the additional stretch factors; and setting the position of the polished rod at the surface unit based on the adjusted static stretch factor to avoid the traveling valve tagging the standing valve at the bottom-of-stroke during the pump cycles.

4. The method of claim 1, further comprising:

using the controller, autonomously:

determining respective successive weight transfer positions and respective recordings of load on the polished rod taken from successive pump cycles of the down-hole pump, determining a weight transfer position variance from the successive weight transfer positions;

determining a variance in load on the polished rod from the successive recorded changes in load on the polished rod, and using the controller, adjusting one or more of the pump operation characteristics for successive pump cycles of the down-hole pump based upon the weight transfer position variance and the recorded changes in load on the polished rod.

5. The method of claim 1, wherein:

the one or more pump operation characteristics comprises compression ratio; and the compression ratio is increased by the controller in response to decreasing values in the recorded changes in load by lowering the bottom-of-stroke for successive pump cycles.

6. The method of claim 1, wherein:

the one or more pump operation characteristics comprises polished rod travel; and the adjustment of polished rod travel comprises autonomous adjustment of (i) the top-of-stroke, (ii) a bottom-of-stroke, or (iii) both the top-of-stroke and the bottom-of-stroke.

7. The method of claim 1, wherein:

the surface pumping unit and the controller are capable of providing infinite polished rod motion control, and the ability to stop, hold, and reverse direction anywhere within travel limits of polished rod movement.

8. The method of claim 1, wherein the one or more pump operation characteristics comprises dwell time at the top-of-stroke and pump cycle rate.

9. The method of claim 6, wherein the controller utilizes the stretch factor to correlate the actual traveling valve position with polished rod position during pumping.

10. The method of claim 9, further comprising:

operating the pumping unit in order to create pump cycles representing upstrokes and downstrokes for the down-hole pump, taking into account the static stretch factor to permit the traveling valve to extend down to the standing valve;

re-measuring the first static position and the second static position; and adjusting the polished rod travel while pumping to ensure the traveling valve opens.

11. A method of reducing gas interference in a wellbore, the wellbore being placed at a well site, and the method comprising:

using a surface pumping unit at the well site, reciprocating a polished rod, a rod string, and a connected traveling valve in order to pump fluids from the wellbore;

during the reciprocating, monitoring a position of the polished rod using a position sensor;

during the reciprocating, monitoring changes in load on the polished rod using a load cell;

during the reciprocating, sending position signals from the position sensor to a controller at the well site;

during the reciprocating, sending load signals from the load cell to the controller at the well site;

using the controller, (a) associating positions of the polished rod and loads on the polished rod as a function of time across a selected number of pump cycles for the surface pumping unit;

(b) determining a weight transfer position (WTP) of the polished rod where the traveling valve is forced open during a downstroke of the rod string across each of the selected number of pump cycles, as WTP readings;

(c) comparing the WTP readings to determine if the weight transfer position is elevating or lowering within the wellbore during the selected number of pump cycles; and (d) recording changes in load on the polished rod as the polished rod travels from a top-of-stroke down to the weight transfer position across the selected number of cycles for the surface pumping unit, as a weight transfer test;

(e) compare results of the weight transfer tests to determine if the changes in load are increasing or decreasing; and (f) based on steps (c) and (e), using the controller to reduce gas interference in the wellbore by (i) changing a dwell time at a top-of-stroke, (ii) adjusting a length of polished rod travel, or (iii) both.

12. The method of claim 11, further comprising:

if a condition of gas interference exists in the wellbore, using the controller to autonomously (iv) decrease pump cycle rate, (v) add dwell time at a top-of-stroke, (vi) decrease length of polished rod travel, or (vii) any combination of (iv), (v), and (vi) while pumping.

13. The method of claim 11, further comprising:

if a condition of no gas interference or less gas interference as previously measured exists in the wellbore, using the controller to autonomously (viii) increase pump cycle rate, (ix) reduce a dwell time at a top-of-stroke, (x) increase length of polished rod travel, or (xi) any combination of (viii), (ix) and (x) while pumping.

14. The method of claim 11, further comprising:

using the controller, calculating average loads with respect to measured positions on the polished rod across a first selected number of pump cycles; and preparing a first surface unit card.

15. The method of claim 14, further comprising:

using the controller, calculating average loads with respect to measured positions on the polished rod across a second subsequent selected number of pump cycles;

preparing a second surface unit card; and comparing a total area or data points within the first surface unit card with a total area or data points within the second surface unit card.

16. The method of claim 15, further comprising:

if a condition of decreased work is presented by the comparing step, autonomously (a) decreasing pump cycle rate, (b) adding a dwell time at a top-of-stroke, (c) decreasing length of polished rod travel, or (d) any combination of (a), (b) and (c); and if a condition of increased work is presented by the comparing step, autonomously (e) increasing pump cycle rate, (f) reducing a dwell time at a top-of-stroke, (g) increasing length of polished rod travel, or (h) any combination of (e), (f) and (g).

17. The method of claim 11, wherein the surface pumping unit and the controller are capable of providing (j) infinite polished rod motion control, and (k) the ability to stop, hold, and reverse direction anywhere within travel limits of polished rod movement.

* * * * *